US010106944B2

(12) United States Patent
Winkes et al.

(10) Patent No.: US 10,106,944 B2
(45) Date of Patent: Oct. 23, 2018

(54) PILE-DRIVER AND METHOD FOR APPLICATION THEREOF

(71) Applicant: Fistuca B.V., Amsterdam (NL)

(72) Inventors: Jasper Stefan Winkes, Amsterdam (NL); Bernard Aart Gerrit Genuit, Eindhoven (NL)

(73) Assignee: Fistuca B.V., Amsterdam (NL)

( * ) Notice: Subject to any disclaimer, the term of this patent is extended or adjusted under 35 U.S.C. 154(b) by 325 days.

(21) Appl. No.: 14/904,982

(22) PCT Filed: Jul. 11, 2014

(86) PCT No.: PCT/NL2014/050475
§ 371 (c)(1),
(2) Date: Jan. 14, 2016

(87) PCT Pub. No.: WO2015/009144
PCT Pub. Date: Jan. 22, 2015

(65) Prior Publication Data

US 2016/0160467 A1 Jun. 9, 2016

(30) Foreign Application Priority Data

Jul. 15, 2013 (NL) ..... 2011166

(51) Int. Cl.
*E02D 7/12* (2006.01)
*E02D 7/02* (2006.01)
(Continued)

(52) U.S. Cl.
CPC ..... *E02D 7/12* (2013.01); *E02D 7/02* (2013.01); *E02D 7/125* (2013.01); *E02D 7/10* (2013.01); *F02B 3/06* (2013.01)

(58) Field of Classification Search
CPC .... E02D 7/00; E02D 7/02; E02D 7/10; E02D 7/12; E02D 7/125; E02D 7/06; F02B 3/00; F02B 3/06
(Continued)

(56) References Cited

U.S. PATENT DOCUMENTS 2,060,139 A 11/1936 Pas
2,633,832 A * 4/1953 Spurlin ..... B21J 7/26 123/305
(Continued)

FOREIGN PATENT DOCUMENTS

CN 2078342 U 6/1991
CN 1888328 A 1/2007
(Continued)

OTHER PUBLICATIONS

PCT International Search Report and Written Opinion, PCT International Application No. PCT/NL2014/050475, dated Oct. 22, 2014.

*Primary Examiner* — Scott A. Smith
(74) *Attorney, Agent, or Firm* — McDonnell Boehnen Hulbert & Berghoff LLP.

(57) ABSTRACT

The present invention relates to a pile-driver, comprising a support member arranged or arrangeable in transverse direction at or on a pile, a liquid chamber which is bounded on the underside by the support member and which further comprises one or more side walls and is configured to receive a liquid therein, one or more pressure build-up chambers, an ignition mechanism configured to ignite a fuel present in the combustion space, and wherein the combustion space is configured to expand fuel present therein during combustion such that a pressure build-up takes place above the support member and the liquid present above the support member in the liquid chamber is displaced at least in upward direction away from the support member,
(Continued)

whereby a downward force is exerted on the pile via the support member. The invention further relates to a method for driving a pile downward into the ground using such a pile-driver.

22 Claims, 8 Drawing Sheets

(51) Int. Cl.
*F02B 3/06* (2006.01)
*E02D 7/10* (2006.01)

(58) Field of Classification Search
USPC ..... 173/1, 2, 91, 128, 209, 210, 133, 135, 173/131, 212; 123/46 SC, 46 H, 292, 123/296; 405/228, 232
See application file for complete search history.

(56) References Cited

U.S. PATENT DOCUMENTS 3,161,184 A * 12/1964 Koftan ..... E02D 7/125 122/250 R
3,595,324 A * 7/1971 Guild ..... E02D 7/125 173/101
3,721,095 A * 3/1973 Chelminski ..... E02D 7/00 405/232
3,800,548 A 4/1974 Wisotsky
3,822,969 A * 7/1974 Kummel ..... E02D 7/125 417/437
3,824,797 A 7/1974 Wisotsky
4,060,139 A 11/1977 Adair
4,098,356 A * 7/1978 Last ..... E02D 7/10 173/131
4,109,475 A * 8/1978 Schnell ..... E02D 7/125 123/46 H
4,187,917 A * 2/1980 Bouyoucos ..... E02D 7/08 173/131
4,580,641 A * 4/1986 Holland ..... E02D 7/125 123/179.31
4,860,835 A * 8/1989 Mauch ..... E02D 7/125 173/128
5,154,667 A * 10/1992 Mauch ..... E02D 7/125 173/135
5,934,245 A * 8/1999 Miller ..... F02B 25/04 123/296
6,102,133 A * 8/2000 Scheid ..... E02D 7/26 173/1
6,634,324 B1 * 10/2003 Mewes ..... E02D 7/125 123/46 R
6,988,564 B2 * 1/2006 White ..... E02D 7/125 173/135
7,404,449 B2 * 7/2008 Bermingham ..... E02D 13/06 173/128
7,695,217 B2 * 4/2010 Hessels ..... E02D 7/06 173/101
7,926,690 B1 * 4/2011 Tippmann, Sr. ..... F01B 11/008 123/46 SC
8,230,940 B2 * 7/2012 Winkes ..... E02D 7/125 173/1
8,763,719 B2 * 7/2014 White ..... E02D 7/125 173/1

FOREIGN PATENT DOCUMENTS

CN 102995639 A 3/2013
CN 103061677 A 4/2013
FR 1001682 A 2/1952
WO 2000/06834 A1 2/2000
WO 2006/111540 A1 10/2006

* cited by examiner

PILE-DRIVER AND METHOD FOR APPLICATION THEREOF

CROSS REFERENCE TO RELATED APPLICATIONS

The present application is a national stage entry of PCT/NL2014/050475, filed 11 Jul. 2014, and claims priority to NL 2011166 filed 15 Jul. 2013. The full disclosures of NL 2011166 and PCT/NL2014/050475 are incorporated herein by reference.

The invention relates to a pile-driver, and more particularly to a pile-driver suitable for offshore operations.

In addition, the invention relates to a method for driving a pile downward into the ground using such a pile-driver.

Drawbacks of existing pile-drivers, particularly for offshore pile-driving, lie in the fact that such pile-drivers are very heavy structures. In offshore applications they are operated by large vessels with heavy cranes provided thereon. The piles are driven one by one into the ground.

The pile-driving itself usually takes place by dropping a ram forming part of a pile hammer onto the pile from some height via a striker plate. Typical properties of such a pile hammer for striking a monopile for the purpose of offshore wind turbines are a length of about 15 m and a mass of about 200 tons (with a ram of 100 tons), as well as an associated striker plate of about 200 tons. Piles are becoming increasingly larger in diameter and length, and piles of 1000 tons and having a diameter of 7 m are currently already being driven. The impact of the falling ram drives a pile into the ground but is accompanied by a considerable noise production. This noise production is particularly undesirable in offshore operations, since sound carries very far in water and may thereby disrupt marine life a great distance away from the pile-driving location.

Proposed in the non-prepublished Netherlands patent application NL 2008169 of Applicant is a pile-driver wherein a flexible member enclosing a combustion space of variable volume is arranged above and close to the support member. A drawback of applying a flexible member is that this member can tear during use and is difficult to access for replacement purposes.

An object of the present invention is to provide a pile-driver and method for application thereof, wherein said drawbacks do not occur, or at least do so to lesser extent.

Said objective is achieved with the pile-driver according to the invention, comprising:

- a support member arranged or arrangeable in transverse direction at or on a pile;
- a liquid chamber which is bounded on the underside by the support member and which further comprises one or more side walls and is configured to receive a liquid therein;
- one or more pressure build-up chambers, comprising:
  - an upper part enclosing a combustion space;
  - a lower part provided with one or more passage openings which are in fluid connection with the liquid chamber;
- an ignition mechanism configured to ignite a fuel present in the combustion space; and
- wherein the combustion space is configured to expand fuel present therein during combustion such that a pressure build-up takes place above the support member and the liquid present above the support member in the liquid chamber is displaced at least in upward direction away from the support member, and a downward force is exerted on the pile via the support member.

The operating principle is based on Newton's first and third laws: "action=reaction". In other words: when an object A exerts a force on an object B, this force is accompanied by an equal but opposite force of B on A. During expansion the combustion space (object A) exerts a force on the medium located thereabove (reaction mass B). According to Newton's third law, the reaction mass (B) exerts an equal but opposite (so downward) force on the combustion space (A). Because the combustion space is located above and close to the support member, the reaction force exerted by the reaction mass on the combustion space will be transmitted via the support member to the pile. The pile hereby undergoes a downward force via the support member, which is utilized according to the invention for the purpose of driving the pile downward into the ground.

In addition, the medium displaced upward during expansion of the combustion space will drop downward again and collide with the support member, where it once again exerts a downward force on the pile via the support member. This operating principle corresponds to the operation of conventional pile-drivers, wherein a ram is dropped from some height onto the pile.

The use of one or more pressure build-up chambers instead of a flexible member provides another significant advantage. In an embodiment in which a flexible member encloses the combustion space, the maximum volume of the combustion space is limited by the maximum stretch of the flexible member. In the embodiment according to the present invention the combustion space can take on a greater volume, and is moreover also more robust.

Applying pressure build-up chambers which enclose a combustion space with an upper part and further comprise a lower part provided with one or more passage openings which are in fluid connection with the liquid chamber, this is in contrast to the pile-driver described in the non-prepublished Netherlands patent application NL 2008169 of Applicant, renders unnecessary the separation provided by the flexible member of NL 2008169 between the combustion chamber and the water. Because such a separating wall can be dispensed with according to the present invention, a more robust pile-driver is obtained which is moreover not limited by the maximum stretch of any flexible member.

In contrast to the typical steel-on-steel impact sound of conventional pile-driving, the pile-driving process according to the invention is accompanied by another type of sound which is less harmful to marine life.

According to a preferred embodiment, the pressure build-up chamber forms a rigid housing, which is robust.

According to a further preferred embodiment, the one or more pressure build-up chambers are attached inside the liquid chamber to the support member. When the fuel in the pressure build-up chambers is ignited and an expansion takes place in the combustion space enclosed by the pressure build-up chambers, the thereby occurring pressure build-up can result almost directly, through the passage openings provided in the lower part of the pressure build-up chambers, in a pressure build-up above the support member.

According to a further preferred embodiment, the one or more side walls of the liquid chamber separate the liquid from the surrounding area. Because the medium is located in the pile hammer or the pile and is thereby closed off at least by the wall of the pile hammer or the pile from the water present outside the pile-driver, only this medium is displaced as a result of the expansion of the combustion space.

Because the displaced medium is isolated from the surrounding area, a shockwave in the surrounding water is prevented. Shockwaves impacting marine life are thus prevented during the pile-driving operations.

According to a further preferred embodiment, the liquid present above the support member in the liquid chamber is water. Water is present in abundance particularly in the case of offshore pile-driving, whereby transport of an alternative medium to the location is unnecessary. A further advantage of water is the high heat transfer coefficient thereof, whereby there is rapid discharge and distribution of the heat released during combustion.

According to a further preferred embodiment, the pile-driver further comprises a fuel supply channel for carrying fuel into the combustion space, and a combustion product discharge channel for discharging combustion products after combustion. Because the combustion space can be filled with fuel and emptied of combustion products in a short time, the system is suitable for a series of successive combustions in a relatively short period of time. It is otherwise noted that, if desired, the same channel can alternately fulfil both functions of fuel supply and combustion product discharge. In that case the channel functions at one moment as the fuel supply channel and the next moment as combustion product discharge channel.

According to a further preferred embodiment, at least a closure is provided which, together with the support member and the one or more side walls, forms a liquid chamber with a volume closed in substantially gas-tight manner, and supply means are further provided for the purpose of thereby carrying a fluid into and/or out of the substantially gas-tight liquid chamber. These supply means can for instance comprise a pump and/or a gas bottle.

According to a further preferred embodiment, the fluid is air and/or water, wherein using the fluid air a pre-pressure can be applied in the substantially gas-tight closed space, and the fluid water provides a reaction mass.

A pile which is driven into the ground encounters a total driving resistance which is the sum of the point resistance and the shaft friction resistance. Depending on parameters such as the soil type, length of the pile and the shape of the pile, both resistances and therefore the total driving resistance vary. Influencing the quantity of water and air present in the substantially gas-tight volume by using the pump makes it possible to optimize the pressure build-up profile in accordance with the driving force desired at that moment. Control means which determine the desired driving force for a specific set of parameters can control the pump accordingly. Tests have shown that, when a pre-pressure is applied, only 5 meters water column can already realize a peak pressure of 10-15 bar. Higher peak pressures can be achieved with a higher water column.

The further the pile has already been driven into the ground, the more rigid it is. The shaft friction resistance in particular also increases as the underground length increases. However, because the pile becomes increasingly more rigid, an increasingly larger amount of reaction mass in the form of water column can also be supported in the pile hammer or in a self-driving pile. The increase in the rigidity of the pile allows a higher centre of gravity of the pile, without the stability being adversely affected.

The point resistance and/or the shaft friction resistance can also be reduced by introducing a liquid during driving of the pile, for instance at the head of the pile or along the wall of the pile. An example of such a liquid is grout, a mixture of cement and water. When this grout later cures, a better attachment of the pile to the soil is also achieved, whereby the load-bearing capacity is ultimately higher than if this pile were to be driven without this liquid.

According to a further preferred embodiment, a plurality of pressure build-up chambers are provided which each comprise an ignition mechanism, and wherein control means are further provided which are configured to ignite the fuel in the pressure build-up chambers in a predetermined sequence and/or at predetermined intervals.

The system can be applied more flexibly by using a plurality of combustion spaces. It is thus possible for instance to coordinate successive combustions with each other in optimal manner. It is possible on the one hand to envisage a subsequent combustion space already being filled with fuel while a combustion space which has just been ignited still has to be emptied of the combustion products present therein. The subsequent combustion can on the other hand take place during the descent of the reaction mass displaced upward in a previous combustion such that the pressure build-up is optimized in accordance with the driving resistance to be overcome at that moment. The ignition controlled by the control means provides the option of generating a desired pressure build-up profile.

According to a further preferred embodiment, control means are provided which are configured to inject extra fuel into a combustion space during the combustion of the fuel and/or to vary the moment of ignition. The pressure build-up profile can hereby be optimized in accordance with the driving force desired at that moment. Control means which determine the desired driving force for a specific set of parameters can control injection of extra fuel accordingly.

According to a further preferred embodiment, at least one opening with a pressure-relief valve is provided in or under the support member. It is noted that 'under' refers to the orientation during the pile-driving process, i.e. the opening is arranged in the wall part between the support member and the ground into which the pile is driven. Arranging a hole of determined (optionally variable) size under the support member makes it possible to regulate the outflow speed of the liquid present under the support member. The descent speed of the pile as a result of an impact can hereby also be limited.

According to a further preferred embodiment, the opening is variable and control means are provided with which the size of the opening can be controlled. The descent speed of the pile can hereby be controlled even better.

According to a further preferred embodiment, the combustion space is in gas connection with an underpressure space which is configured to suction combustion products released during combustion out of the combustion space. By means of an underpressure the combustion products released during combustion are suctioned out of the combustion space in a very short time. The combustion products can hereby be removed before the medium displaced in upward direction by the combustion drops hack and collides once again with the support member. Because the falling medium does not drop onto a 'gas spring' but actually 'strikes' the support member, the downward energy transmitted to the support member by this falling medium can be utilized substantially wholly to drive the pile downward into the ground.

According to a further preferred embodiment, the pile-driver is integrated into the pile which forms with its side wall a side wall of the liquid chamber. Because the pile-driver is integrated into the pile, a plurality of piles can be driven substantially simultaneously, whereby marine life is exposed for a much shorter period of time to noise nuisance resulting from the pile-driving. For locations with a water depth of more than 25 meters it is usual to apply special frames, also referred to as space frames or jackets. These framework constructions transmit the forces via a number of piles to the seabed in order to minimize the mass/stiffness ratio. A drawback of such frameworks is that each pile has to be driven individually or each pile is anchored separately, which, with the conventional pile-drivers, takes a number of working hours proportional to the number of piles. Arranging the pile extendably in a post of the framework construction (or space frame or jacket) as desired enables this framework to be submerged to the seabed, after which the pile can be driven downward from the framework into the seabed. Because a conventional pile-driver is not required when the pile-driver is integrated into a pile, according to the invention the different piles can be driven substantially simultaneously into the ground. In the system according to the invention the number of working hours is not therefore proportional to the number of piles: the driving of three piles takes almost the same amount of time as driving a single pile. This is particularly advantageous for marine life, which is exposed for a much shorter period of time to noise nuisance resulting from the pile-driving.

The system according to the invention is therefore able to pile-drive preassembled constructions, wherein the foundation is, if desired, already attached to the wind turbine. Such a construction can be shipped in and submerged before the construction is driven into place.

A further advantage of a conventional pile-driver being unnecessary is that such a heavy structure with correspondingly suitable vessel is unnecessary. It suffices to place a pile using a crane suitable for the purpose and correspondingly suitable vessel, and to drive the pile only partially into the ground, after which the vessel with the crane can be replaced by a smaller vessel. This is particularly advantageous, since operation of such a large vessel and conventional pile-driver involves considerable cost.

Excessive groundwater pressure may occur after pile-driving. This needs time to even out, after which further driving can take place in order to impart sufficient load-bearing capacity to the pile. Where, with a conventional pile-driving technique, a large vessel has to wait for the excessive groundwater pressure to even out, this is unnecessary in the pile-driving system according to the invention when the pile-driver is integrated into a pile. If desired, a small vessel remains behind in order to generate a number of further combustion cycles via the operating principle of the invention, although it is also possible to envisage this taking place wholly autonomously after some time. It is sufficient that enough fuel and control means are available for this purpose.

The invention further relates to a method for driving a pile downward into the ground, comprising the steps of:

- arranging a support member in transverse direction at or on a pile;
- receiving a liquid in a liquid chamber which is bounded on the underside by the support member;
- supplying a fuel to a pressure build-up chamber, wherein the pressure build-up chamber comprises:
  - an upper part enclosing a combustion space; and
  - a lower part provided with one or more passage openings which are in fluid connection with the liquid chamber;
- wherein a quantity of gas builds up in the upper part of the pressure build-up chamber when fuel is supplied to the pressure build-up chamber and thereby presses the liquid away downward in the pressure build-up chamber;
- bringing the fuel located above the liquid level in the pressure build-up chamber to combustion using an ignition mechanism, whereby an expansion takes place;
- displacing by means of the expansion at least some of the liquid and/or combustion products present in the pressure build-up chamber from the pressure build-up chamber via the fluid connection to the liquid chamber;
- whereby a pressure build-up takes place above the support member and whereby the liquid located above the support member in the liquid chamber is also displaced at least in upward direction away from the support member; and
- driving the pile downward into the ground with the downward reaction force exerted on the pile.

According to a preferred embodiment, the method further comprises the steps of:

- carrying fuel into the combustion space of the pressure build-up chamber through a fuel supply channel;
- combusting the fuel in the pressure build-up chamber using the ignition mechanism;
- discharging combustion products through a combustion product discharge channel after combustion; and
- repeating these steps in order to drive the pile stepwise into the ground.

According to a further preferred embodiment, the method further comprises the step of injecting extra fuel into the combustion space during combustion of the fuel. The pressure build-up profile can hereby be optimized in accordance with the pile-driving force desired at that moment. If desired, control means which determine the desired driving force for a specific set of parameters control the injection of extra fuel accordingly.

According to a further preferred embodiment, at least a closure is provided which, together with the support member and the one or more side walls, forms a liquid chamber with a volume closed in substantially gas-tight manner, and the method comprises the step of carrying a fluid into and/or out of the substantially gas-tight liquid chamber using a supply means such as a pump or gas bottle. Influencing the quantity of water and air present in the substantially gas-tight volume using the supply means enables the pressure build-up profile to be optimized in accordance with the driving force desired at that moment.

According to a further preferred embodiment, the fluid is air and brings about a pre-pressure.

According to a further preferred embodiment, the fluid is water and provides a reaction mass.

According to a further preferred embodiment, the combustion space is in gas connection with an underpressure space and the method comprises the step, almost immediately after a combustion, of suctioning out of the combustion space the combustion products formed therein by the combustion, so that these combustion products are at least substantially removed from the combustion space before the medium displaced in upward direction by the combustion drops back and collides once again with the support member.

According to a further preferred embodiment of the method, a pile-driver according to the invention is applied.

Preferred embodiments of the present invention are further elucidated in the following description with reference to the drawing, in which.

Figure 1:
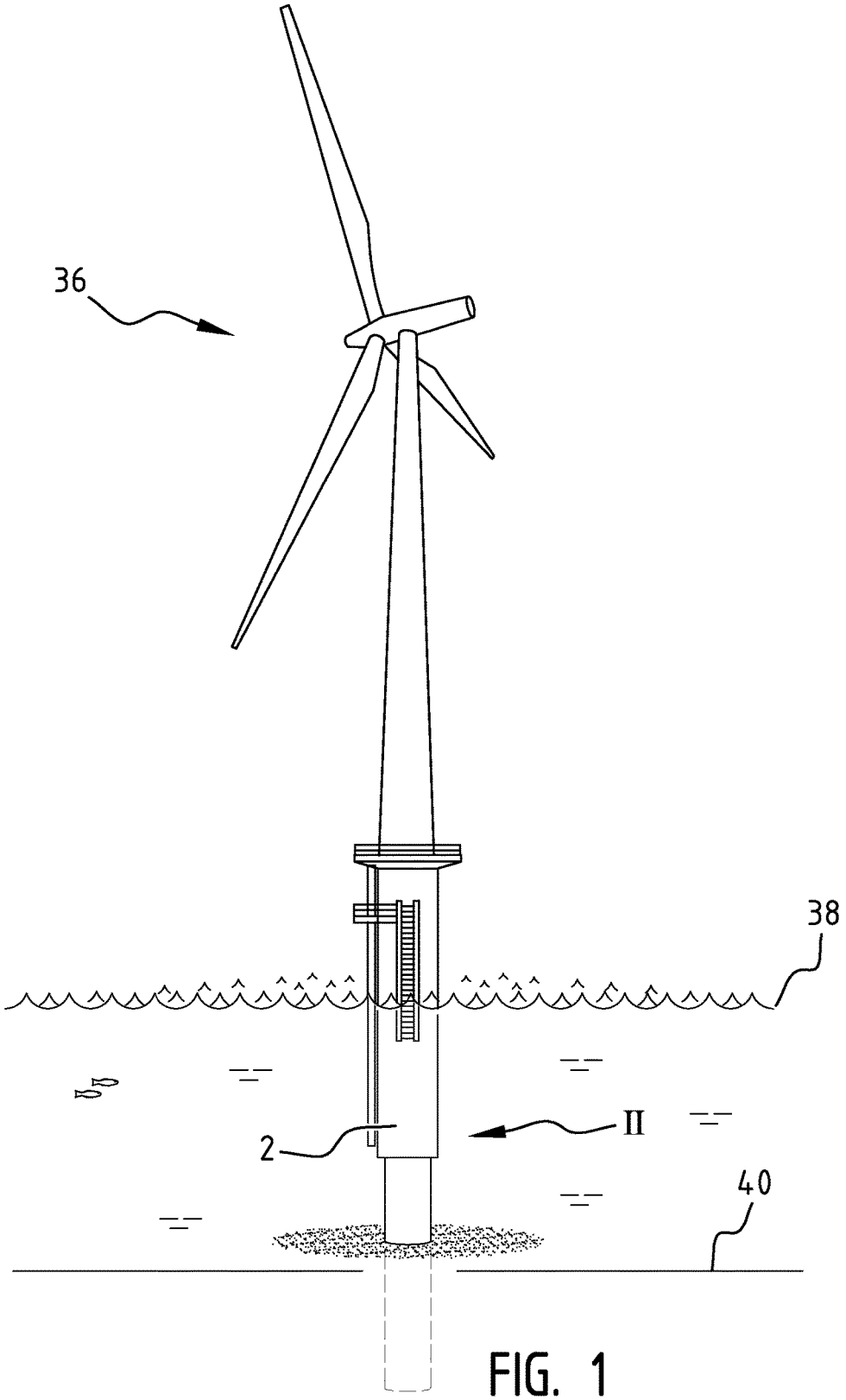
FIG. 1 shows a view of an offshore wind turbine on a monopile construction.

The offshore wind turbine 36 shown in FIG. 1 is a so-called monopile construction and comprises a pile 2 which is driven fixedly into the ground 40, formed by the seabed, below water level 38.

Figure 2:
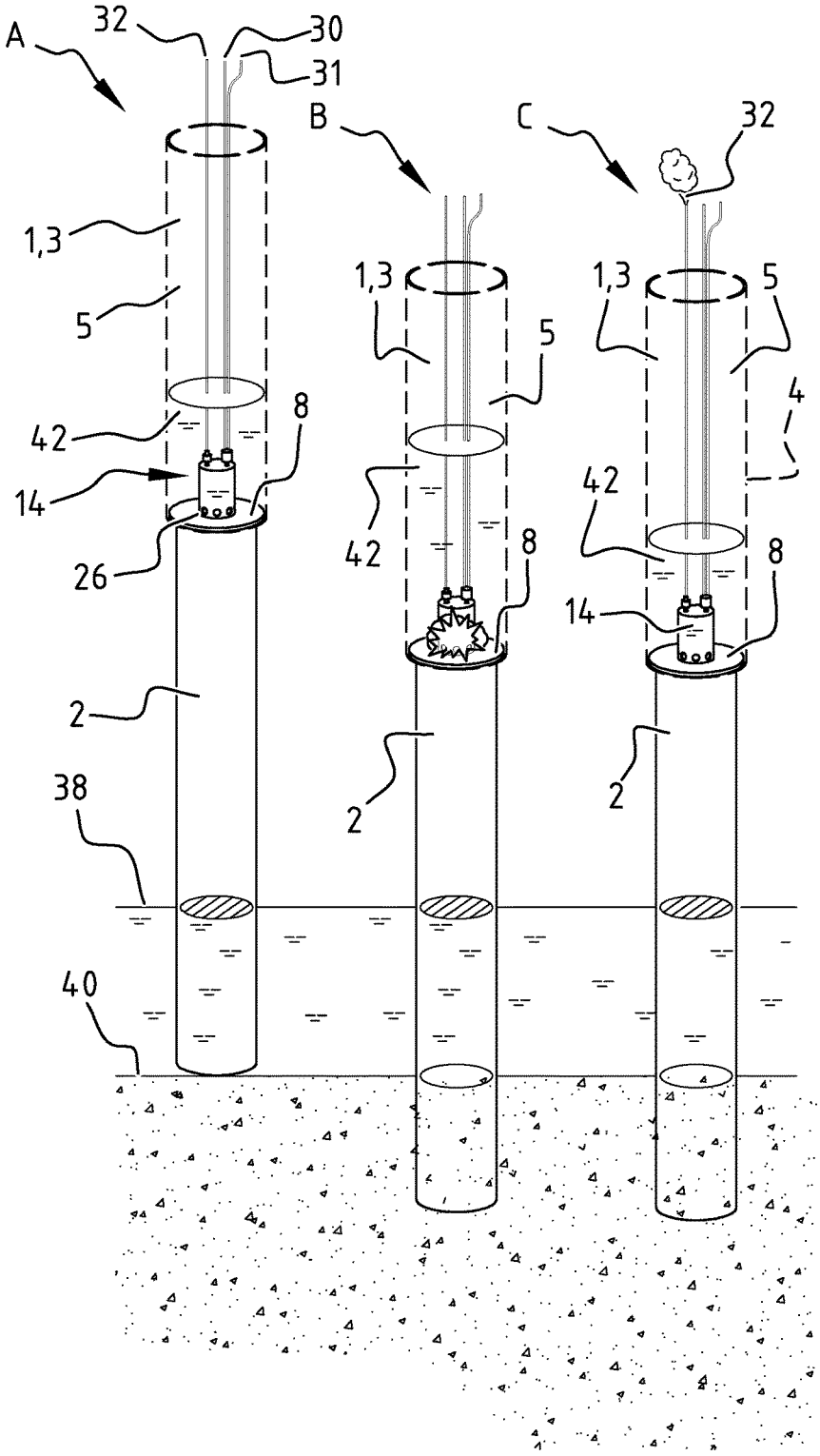
FIG. 2 shows a schematic view of the operating principle at three successive stages A, B and C.

The operating principle of fixedly driving the wind turbine construction 36 of FIG. 1 is shown schematically in FIG. 2 using stages A, B and C. Arranged on pile 2 is a pile-driver 1 in the form of a pile hammer 3. This pile hammer 3 has a bottom plate part, which functions as support member 8, and a side wall 4. Support member 8 and side wall 4 together form a liquid chamber 5 in which a water column 42 is received (stage A). Bringing a fuel mixture 29 to combustion in a pressure build-up chamber 14 brings about an expansion which generates a homogenous pressure build-up above support member 8 which drives pile 2 downward into ground 40. Water column 42 is moreover displaced upward (stage B). According to Newton's third law the upward displacement of water column 42 is accompanied by an equal and opposite reaction force, which displaces pile 2 in downward direction. When it drops back this water column 42 will moreover come down onto support member 8 and thus exert a downward force on pile 2 which drives the pile further downward into the ground.

It is noted that the operating principle in FIG. 2 is shown on enlarged scale. In stage C pile 2 has already been driven over some downward distance into ground 40.

The different stages of the operating principle will now be elucidated in more detail with reference to FIGS. 3A-3E.

Figure 3C:
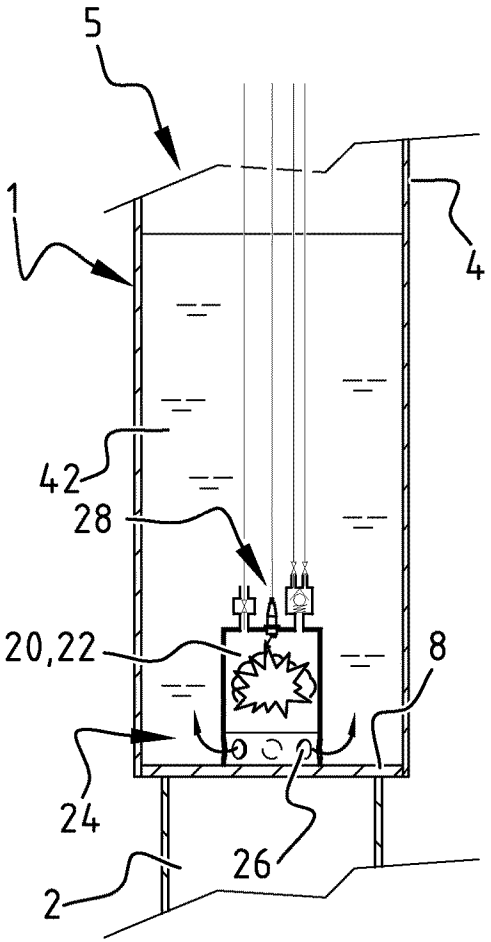
FIGS. 3A-3E are detailed cross-sectional views of the support member of the device shown in FIG. 2.
Figure 3B:
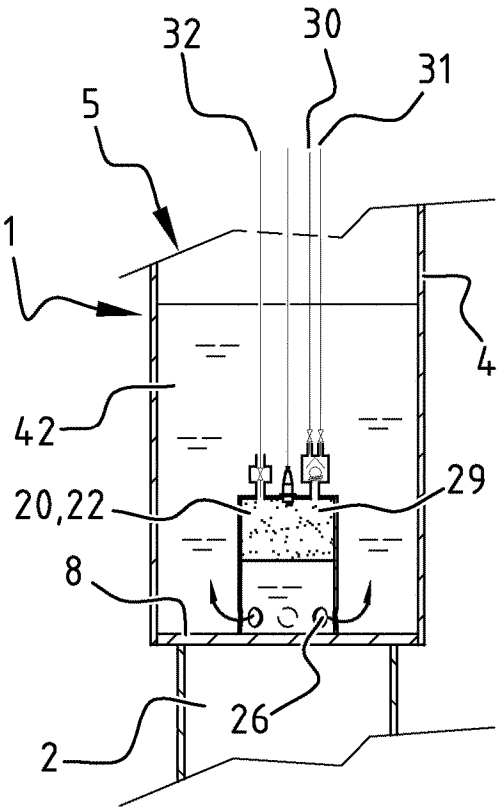
Figure 3A:
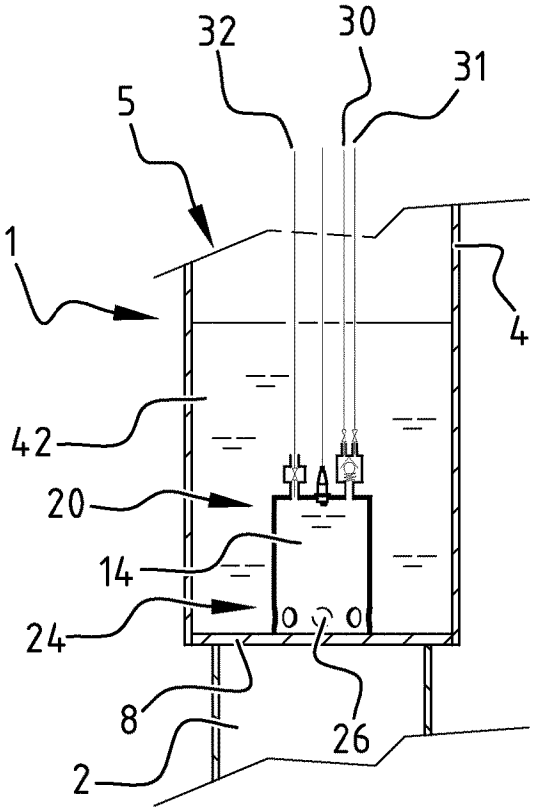

FIG. 3A shows a starting situation in which a water column 42 is present in liquid chamber 5. Liquid chamber 5 is bounded by support member 8 and side wall 4 of pile-driver 1. Although other media are likewise suitable, use is preferably made of the medium water, which is available in abundance offshore. Reference is therefore made in this application to a water column 42.

A fuel mixture is introduced via a fuel supply channel 30 and an oxygen supply channel 31 into the combustion space enclosed by the upper side of the pressure build-up chamber (FIG. 3B). This gas mixture presses the water present in the pressure build-up chamber 14 downward and, via passage openings 26 arranged in the lower part of the pressure build-up chamber 14, outward from the volume enclosed by the pressure build-up chamber 14 into water column 42. The water level of water column 42 will hereby rise to some extent.

If desired, the fuel supply channel 30 supplies a fuel mixture, in which case the oxygen supply channel may be unnecessary. It is even possible to envisage there being a single channel which alternately fulfils the function of the fuel supply channel 30 and that of a combustion gas discharge channel 32 to be discussed below.

When the fuel mixture 29 present in combustion space 22 is ignited with an ignition mechanism 28 (FIG. 3C), an expansion will take place in a very short time which will also displace a large part of the water still present in the pressure build-up chamber 14 via passage openings 26 to the water column 42 outside pressure build-up chamber 14. This results in an increased homogeneous pressure above support member 8, whereby a downward force is exerted on pile 2 which is driven further into ground 40. The effect of water column 42 displacing upward and dropping back again onto support member 8 already mentioned with reference to FIG. 2 will also occur. This will drive pile 2 further into ground 40.

It is possible to envisage some of fuel mixture 29 being ignited outside the pressure build-up chamber 14 and displacing in burning state via the fuel supply channel 30 to the pressure build-up chamber 14, and bringing to combustion the fuel mixture 29 already present in combustion space 22.

The water level inside the pressure build-up chamber 14 ideally remains slightly above passage openings 26 during the expansion phase so that only water is displaced from the pressure build-up chamber 14 via the passage openings to the space outside the pressure build-up chamber. This guarantees that pile-driver 1 will quickly be operational again for a subsequent combustion cycle, which will be further elucidated with reference to FIG. 8.

Figure 3E:
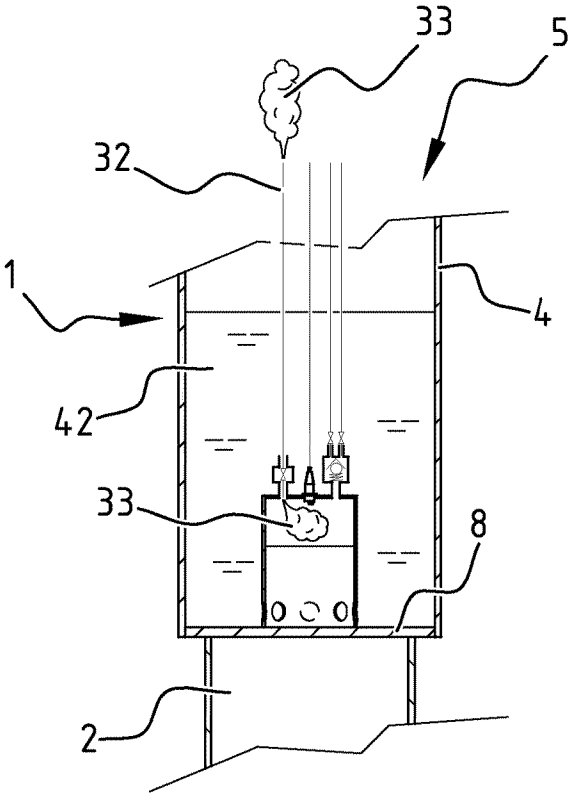
Figure 3D:
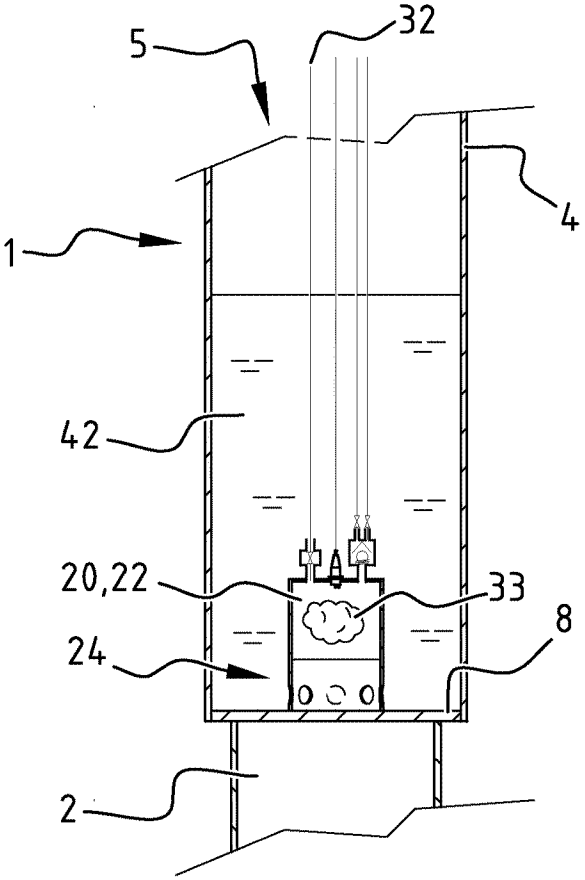

Combustion products 33 are formed in combustion space 22 by the combustion process of fuel mixture 29 (FIG. 3D). These combustion products 33 are discharged using a combustion gas discharge channel 32 (FIG. 3E). The water level in pressure build-up chamber 14 will rise and, as soon as water flows into the combustion gas discharge channel 32, the combustion products 33 are fully discharged from upper part 24 of pressure build-up chamber 14. The system will then be in the situation of FIG. 3A and is ready for a subsequent combustion cycle.

The combustion products can be removed from combustion space 22 before water column 42 displaced in upward direction by the expansion drops back and once again collides with support member 8. The falling water column 42 does not hereby come down onto a 'gas spring' but collides with support member 8. The downward force exerted by the falling water column 42 on support member 8 can hereby be utilized almost wholly for the purpose of driving pile 2 downward into the ground.

As a pile 2 is driven deeper into ground 40, pile 2 will obtain more stability and be able to bear more mass. The total pile-driving resistance encountered by pile 2 is the sum of the point resistance and the shaft friction resistance. The shaft friction resistance increases as a greater part of pile 2 is driven into ground 40. Since this situation is also associated with a pile 2 which has already obtained some stability, the height of water column 42 in liquid chamber 5 can be increased.

Figure 4:
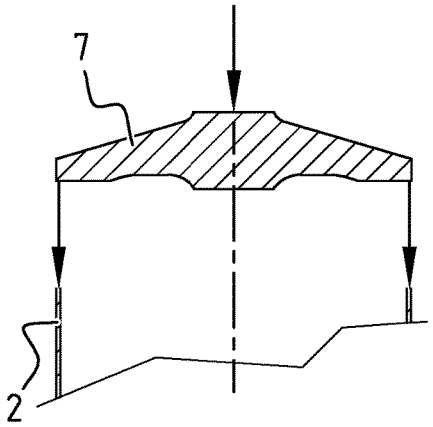
FIG. 4 is a schematic view of the transmission of forces in a conventional pile-driver.
Figure 5:
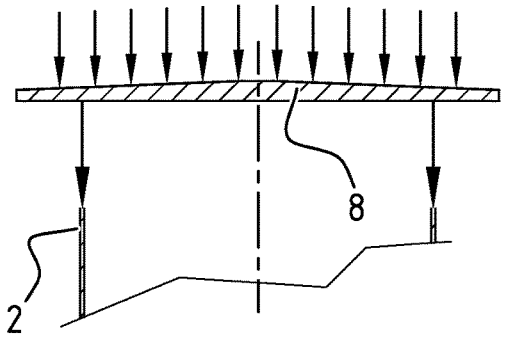
FIG. 5 is a schematic view of the transmission of forces in a pile-driver according to the invention.

The transmission of forces in a conventional pile-driver (FIG. 4) is much more concentrated than in the pile-driver 1 according to the invention (FIG. 5). In a conventional pile-driver steel-to-steel contact takes place, wherein a striker plate 7 is struck. This is accompanied by considerable noise production and high peak forces, whereby such as striker plate 7 must take a very heavy form. In pile-driver 1 according to the invention however, a homogenous pressure build-up takes place above support member 8. Because much less plastic deformation occurs according to the invention, a much thinner and lighter plate can be applied for support member 8.

Figure 6:
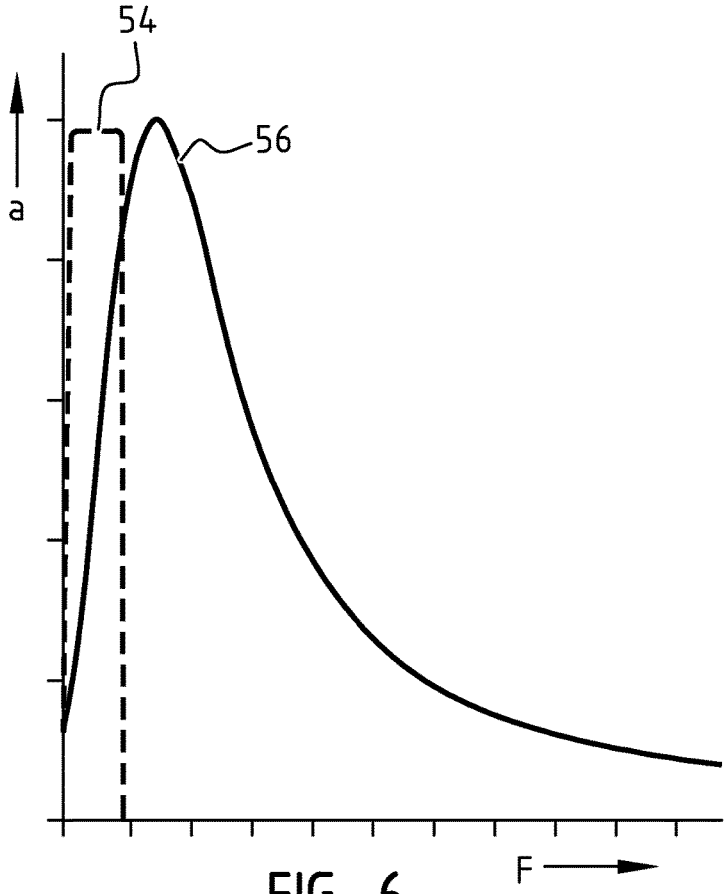
FIG. 6 shows a graph in which a typical force curve of the pile-drivers of FIGS. 4 and 5 is plotted.

FIG. 6 shows a graph which plots a typical force curve of the conventional pile-driver shown in FIG. 4 (line 54) and the pile-driver 1 shown in FIG. 5 (line 56). Shown clearly here in the case of pile-driver 1 according to the invention is that the profile has a longer pulse duration, whereby the pile-driving process is quieter, more descent is achieved per stroke and lower tensile forces occur. Because there is more descent per stroke, fewer strokes are necessary, this placing the pile under less fatigue load during pile-driving. The build-up of force is moreover more gradual and, in the case of for instance a monopile, this allows components arranged thereon to be applied without the risk of them breaking off during driving. The longer pulse duration ensures that tensile stress waves occurring in the material are smaller, whereby it is even possible to drive concrete piles.

Figure 7:
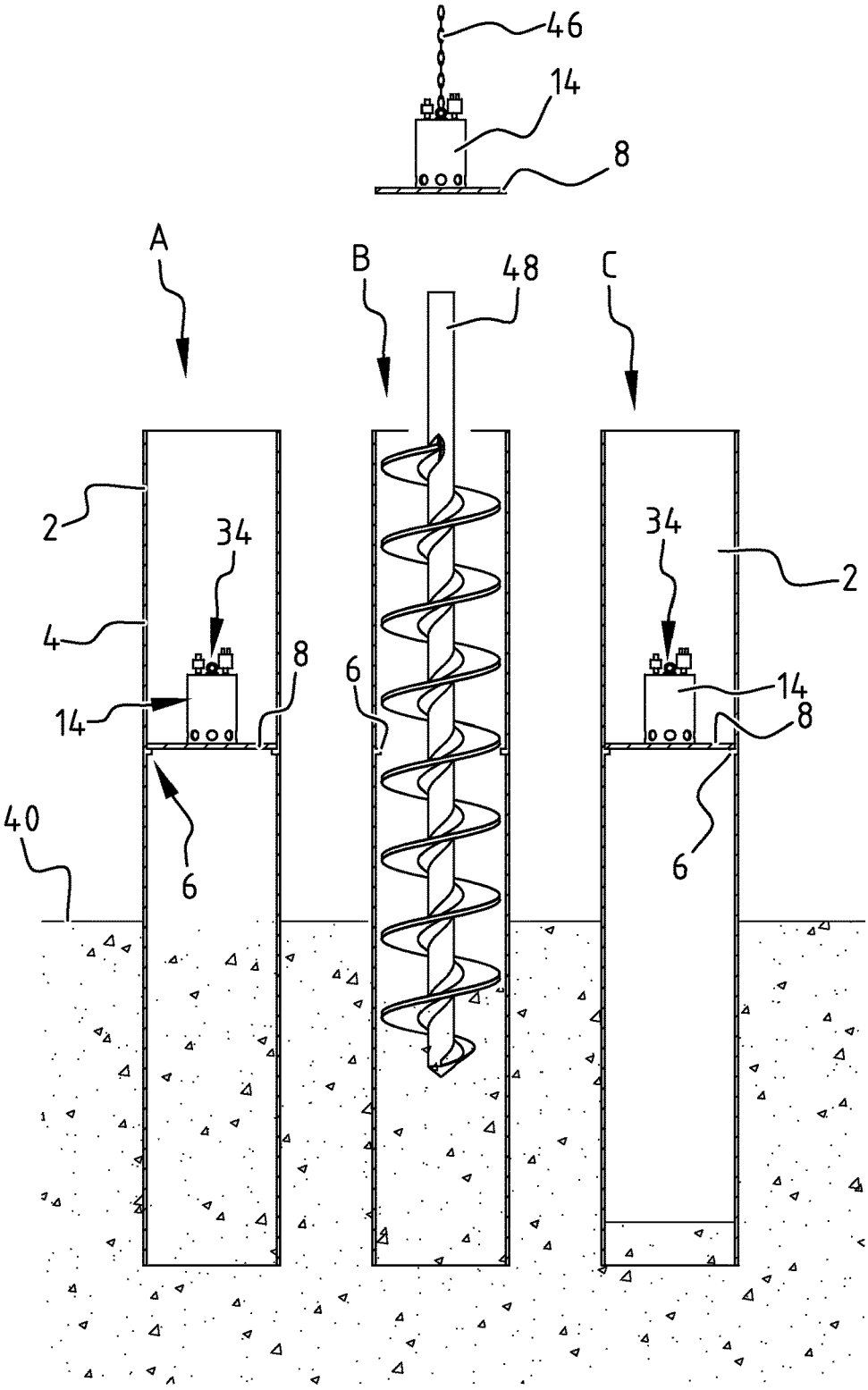
FIG. 7 is a schematic view of three successive stages A, B and C when drilling-out is desired.

Water column 42 is separated from the surrounding area by a separating wall 4. In the embodiment in which pile-driver 1 is integrated into pile 2, the inner wall of pile 2 forms this separating wall 4 (FIG. 7).

If the pile-driver is integrated into pile 2, support member 8 preferably rests on protrusions or inner edge 6 which is arranged on inner wall 4 of pile 2 and which provides a local narrowing (stage A). Support member 8 is in this way temporarily removable from pile 2 (stage B), for instance by attaching a chain 46 to eye 34 and hoisting the whole. Pile 2 can then be drilled out using a drill 48, which may be necessary in the exceptional situation that the shaft resistance cannot be overcome with combustions according to the operating principle of the invention. After the soil has been drilled out of pile 2, support member 8 with the one or more pressure build-up chambers 14 can be re-placed (stage C).

Figure 8:
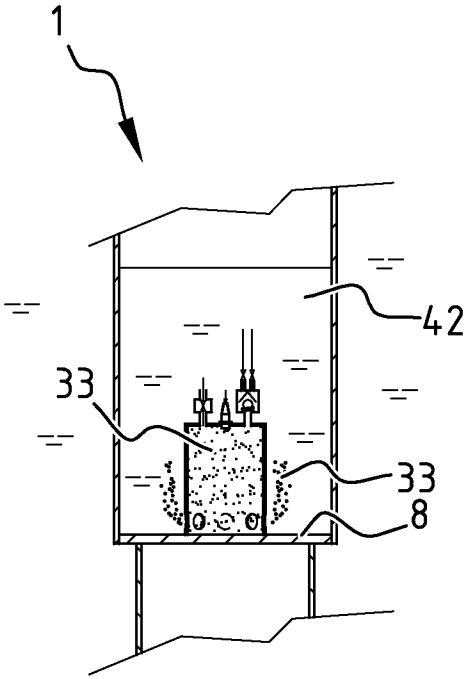
FIG. 8 is a schematic view of an extra-powerful pressure build-up.

It is however noted that the above stated situation will probably be a rare occurrence, since pile-driver 1 according to the invention is also suitable—if necessary—for carrying out stronger combustions. The combustion space 22 enclosed by pressure build-up chamber 14 is for this purpose filled to the point that during expansion not only water but also combustion gases 33 are displaced via passage openings 26 out of the volume enclosed by pressure build-up chamber 14 to the space outside pressure build-up chamber 14 (FIG. 8). The combustion space is in this way temporarily made larger.

A drawback is that combustion gases will get into the water column 42 of pile-driver 1, with the result that owing to the gas the driving mass will acquire some compressibility. The desired incompressibility of the water column is restored by allowing the gas time to rise through the water column. This takes time however, whereby these stronger combustions are preferably utilized only when necessitated by the shaft resistance.

According to an alternative embodiment, the connections for the various supply channels 30, 31, 32 and ignition mechanism 28 are arranged in a unit 58 outside liquid chamber 5 of pile-driver 1. A feed channel 60 extending through wall 4 of pile-driver 1 provides the connection to pressure build-up chamber 14. Because unit 58 and all connections of supply channels 30, 31, 32 and ignition mechanism 28 are arranged outside liquid chamber 5, these components are easily accessible.

Figure 10:
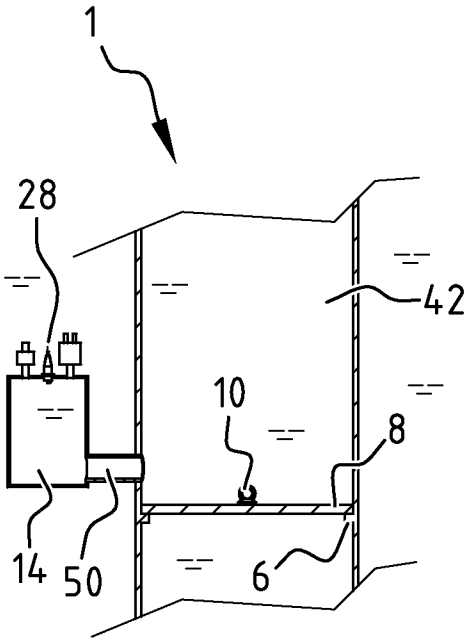
FIG. 10 shows an alternative embodiment wherein the pressure build-up chamber is arranged outside the liquid chamber of the pile-driver.
Figure 9:
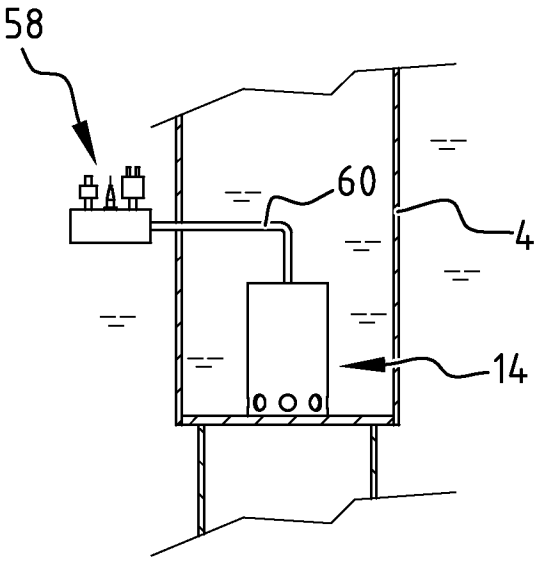
FIG. 9 shows an alternative embodiment wherein the connections for the various conduits are arranged in a unit outside the liquid chamber of the pile-driver and are connected to the pressure build-up chamber via a feed channel.

It is also possible to envisage the pressure build-up chamber 14 being arranged outside liquid chamber 5 of pile-driver 1 (FIG. 10). One or more passage openings 26 in the wall of pressure build-up chamber 14 are in that case brought into fluid connection with liquid chamber 5 via a feed channel 50. In this embodiment support member 8 can itself be provided with an eye 10 so that it can be lifted from inner edge 6 using a chain should it be necessary to drill out pile 2.

In a particularly advantageous embodiment in which pile 2 and pile-driver 1 are integrated, at least one opening (not shown) with a pressure-relief valve is provided in the support member 8 itself or, if desired, under support member 8 in the wall of pile 2. Overpressure occurring under support member 8 during pile-driving can escape through this opening from the space enclosed by support member 8, the inner wall of pile 2 and the ground 40. The opening provides a restrictive passage with which the outflow speed can be regulated. The descent speed of pile 2 as a result of an impact can hereby also be limited, whereby the opening reduces the chance of undesired shock load on the crane.

Figure 11:
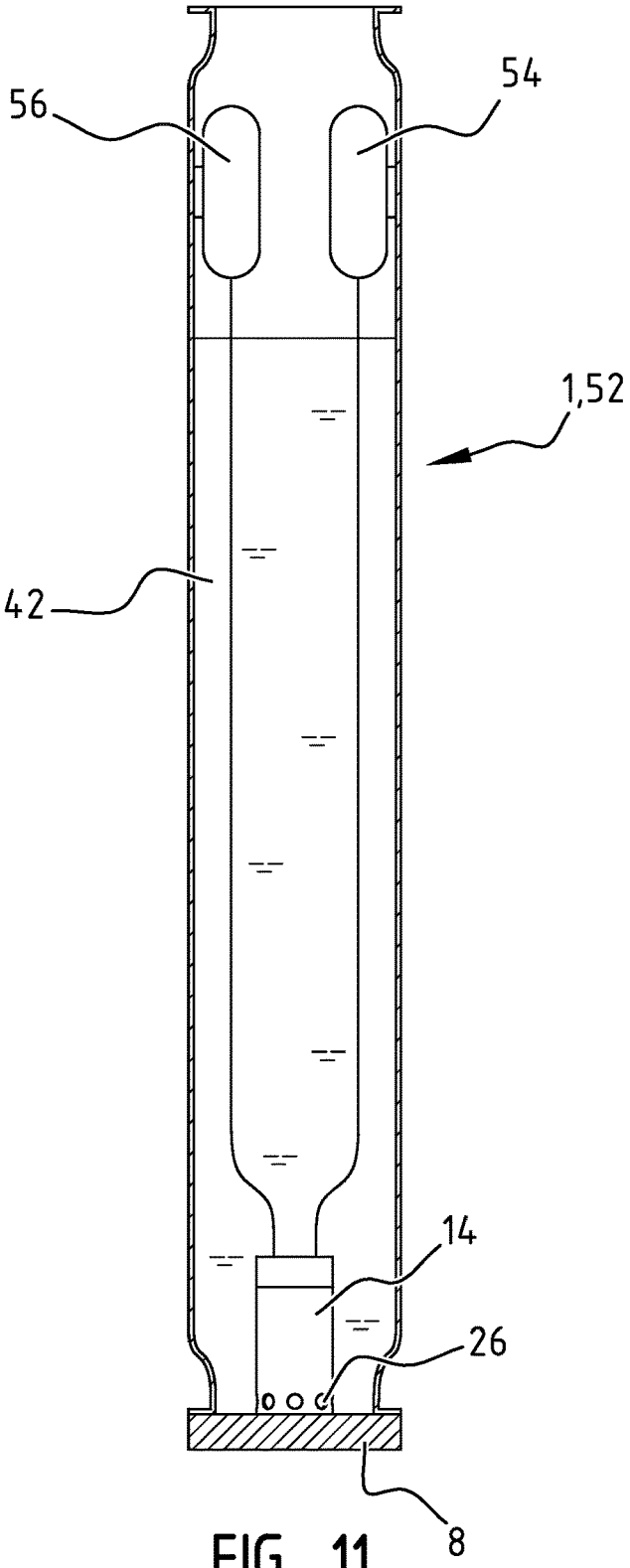
FIG. 11 shows a further alternative embodiment for deepwater pile-driving.

FIG. 11 shows an alternative embodiment for deepwater pile-driving, wherein the shown tube segment 52 can be coupled to other similar tube segments in order to reach a great depth. The operating principle is identical to that described above, and will not therefore be further elucidated. It is however noted that reservoirs 52, 54 contain respectively oxygen and hydrogen. The chemical reaction during combustion produces water as end product, which can be added without problem to water column 42. If desired, the embodiment of FIG. 11 enables pile-driver 1 to comprise one or more fully closed tubes segments 52, which can result from tube segment parts 52 being coupled to each other. A self-driving, submersible pile-driver 1 can moreover be constructed in this way.

Provided according to a further preferred embodiment (not shown) on the upper side of pile-driver 1 is a closure which, together with support member 8 and the inner wall 4 of pile-driver 1, encloses a volume closed in substantially gas-tight manner. With a pump air and/or water can be introduced into this closed volume, whereby the pressure build-up profile resulting from the combustion of the fuel mixture in combustion space 22 can be optimized for driving pile 2 downward into ground 40. The height of water column 42 can on the one hand be adjusted, and the desired pre-pressure resulting from the quantity of air present in the closed volume can on the other hand be adjusted so as to optimize the desired pressure build-up.

Although they show preferred embodiments of the invention, the above described embodiments are intended solely to illustrate the present invention and not to limit the scope of the invention in any way. When measures in the claims are followed by reference numerals, such reference numerals serve only to contribute toward understanding of the claims, but are in no way limitative of the scope of protection. It is particularly noted that the skilled person can combine technical measures of the different embodiments. The described rights are defined by the following claims, within the scope of which many modifications can be envisaged.

What is claimed is:

1. A pile-driver, comprising:

a support member arranged or arrangeable in transverse direction at or on a pile;

a liquid chamber which is bounded on the underside by the support member and which further comprises one or more side walls and is configured to receive a liquid therein;

one or more pressure build-up chambers, comprising:

an upper part enclosing a combustion space;

a lower part provided with one or more passage openings which are in fluid connection with the liquid chamber;

an ignition mechanism configured to ignite a fuel present in the combustion space; and wherein the combustion space is configured to expand fuel present therein during combustion such that a pressure build-up takes place above the support member and the liquid present above the support member in the liquid chamber is displaced at least in upward direction away from the support member, and a downward force is exerted on the pile via the support member.

2. The pile-driver as claimed in claim 1, wherein the pressure build-up chamber forms a rigid housing.

3. The pile-driver as claimed in claim 1, wherein the one or more pressure build-up chambers are attached inside the liquid chamber to the support member.

4. The pile-driver as claimed in claim 1, wherein the one or more side walls of the liquid chamber separate the liquid from the surrounding area.

5. The pile-driver as claimed in claim 1, wherein the liquid present above the support member in the liquid chamber is water.

6. The pile-driver as claimed in claim 1, further comprising:

a fuel supply channel for carrying fuel into the combustion space; and a combustion product discharge channel for discharging combustion products after combustion.

7. The pile-driver as claimed in claim 1, wherein:

at least a closure is provided which, together with the support member and the one or more side walls, forms a liquid chamber with a volume closed in substantially gas-tight manner; and supply means are provided for the purpose of thereby carrying a fluid into and/or out of the substantially gas-tight liquid chamber.

8. The pile-driver as claimed in claim 7, wherein the fluid is air and/or water.

9. The pile-driver as claimed in claim 1, wherein a plurality of pressure build-up chambers are provided which each comprise an ignition mechanism, and wherein control means are further provided which are configured to ignite the fuel in the one or more pressure build-up chambers in a predetermined sequence and/or at predetermined intervals.

10. The pile-driver as claimed in claim 1, wherein control means are provided which are configured to inject extra fuel into a combustion space during the combustion of the fuel to vary the moment of ignition.

11. The pile-driver as claimed in claim 1, wherein at least one opening, with a pressure-relief valve, is provided in or under the support member.

12. The pile-driver as claimed in claim 11, wherein the opening is variable and control means are provided with which the size of the opening can be controlled.

13. The pile-driver as claimed in claim 1, wherein the combustion space is in gas connection with an underpressure space which is configured to suction combustion products released during combustion out of the combustion space.

14. The pile-driver as claimed in claim 1, wherein the pile-driver is integrated into the pile which forms with its side wall a side wall of the liquid chamber.

15. A method for driving a pile downward into the ground, comprising the steps of:

arranging a support member in transverse direction at or on a pile;

receiving a liquid in a liquid chamber which is bounded on the underside by the support member;

supplying a fuel to a pressure build-up chamber, wherein the pressure build-up chamber comprises:

an upper part enclosing a combustion space; and a lower part provided with one or more passage openings which are in fluid connection with the liquid chamber;

wherein a quantity of gas builds up in the upper part of the pressure build-up chamber when fuel is supplied to the pressure build-up chamber and thereby presses the liquid away downward in the pressure build-up chamber;

bringing the fuel located above the liquid level in the pressure build-up chamber to combustion using an ignition mechanism, whereby an expansion takes place;

displacing by means of the expansion at least some of the liquid and/or combustion products present in the pressure build-up chamber from the pressure build-up chamber via the fluid connection to the liquid chamber;

whereby a pressure build-up takes place above the support member and whereby the liquid located above the support member in the liquid chamber is also displaced at least in upward direction away from the support member; and driving the pile downward into the ground with the downward reaction force exerted on the pile.

16. The method as claimed in claim 15, further comprising the steps of:

carrying fuel into the combustion space of the pressure build-up chamber through a fuel supply channel;

combusting the fuel in the pressure build-up chamber using the ignition mechanism;

discharging combustion products through a combustion product discharge channel after combustion; and repeating these steps in order to drive the pile stepwise into the ground.

17. The method as claimed in claim 16, further comprising the step of injecting extra fuel into the combustion space during combustion of the fuel.

18. The method as claimed in claim 15, wherein at least a closure is provided which, together with the support member and the one or more side walls, forms a liquid chamber with a volume closed in substantially gas-tight manner; and comprising the step of carrying a fluid into and/or out of the substantially gas-tight liquid chamber using a supply means.

19. The method as claimed in claim 18, wherein the fluid is air and brings about a pre-pressure.

20. The method as claimed in claim 18, wherein the fluid is water and provides a reaction mass.

21. The method as claimed in claim 15, wherein the combustion space is in gas connection with an underpressure space and the method comprises the step, almost immediately after a combustion, of suctioning out of the combustion space the combustion products formed therein by the combustion, so that these combustion products are at least substantially removed from the combustion space before the medium displaced in upward direction by the combustion drops back and collides once again with the support member.

22. The method as claimed in claim 15, wherein a pile-driver according to claim 1 is applied.

* * * * *